US008654169B2

(12) United States Patent
Arai et al.

(10) Patent No.: US 8,654,169 B2
(45) Date of Patent: Feb. 18, 2014

(54) IMAGE FORMING DEVICE AND IMAGE FORMING METHOD

(75) Inventors: Yoshio Arai, Nagano (JP); Nozomu Inoue, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 229 days.

(21) Appl. No.: 12/884,893

(22) Filed: Sep. 17, 2010

(65) Prior Publication Data

US 2011/0090297 A1 Apr. 21, 2011

(30) Foreign Application Priority Data

Oct. 15, 2009 (JP) ..... 2009-238253

(51) Int. Cl.
*B41J 2/435* (2006.01)
*B41J 2/47* (2006.01)

(52) U.S. Cl.
USPC ..... 347/246; 347/236; 347/247; 347/237; 347/253

(58) Field of Classification Search
USPC ..... 347/253, 236–237, 246–247
See application file for complete search history.

(56) References Cited

U.S. PATENT DOCUMENTS

| | | | | |
|---|---|---|---|---|
| 8,310,514 | B2 * | 11/2012 | Yamaguchi et al. | 347/238 |
| 2004/0095455 | A1 * | 5/2004 | Ishida et al. | 347/130 |
| 2007/0188584 | A1 * | 8/2007 | Nakamura et al. | 347/133 |
| 2008/0030566 | A1 | 2/2008 | Nomura et al. | |
| 2009/0051910 | A1 * | 2/2009 | Imura | 356/243.8 |
| 2010/0039489 | A1 | 2/2010 | Nomura et al. | |

FOREIGN PATENT DOCUMENTS

| | | | |
|---|---|---|---|
| JP | 2005081701 | A * | 3/2005 |
| JP | 2008-36937 | A | 2/2008 |
| JP | 4115253 | B | 4/2008 |
| JP | 2008-238633 | A | 10/2008 |

* cited by examiner

*Primary Examiner* — Sarah Al Hashimi
(74) *Attorney, Agent, or Firm* — Global IP Counselors, LLP

(57) ABSTRACT

An image forming device includes: an exposure head that includes a light emitting element and a light emission controller that causes the light emitting element to emit light on the basis of a control signal; a photoreceptor that is exposed to the light emitted by the light emitting element included in the exposure head so that a latent image is formed on the photoreceptor; a correcting section that corrects the control signal on the basis of the spectral sensitivity of the photoreceptor to a spectral distribution of the light emitting element; and a developing section that develops the latent image formed on the photoreceptor.

5 Claims, 10 Drawing Sheets

FIG. 8

| i | WAVELENGTH λi (nm) | INTENSITY Pi OUTPUT FROM SPECTROSCOPE (ANALOG-TO-DIGITAL CONVERTED COUNT VALUE) | λi×Pi |
|---|---|---|---|
| 1 | 550 | 0 | 0 |
| 2 | 560 | 20 | 11200 |
| 3 | 570 | 200 | 114000 |
| 4 | 580 | 600 | 348000 |
| 5 | 590 | 1000 | 590000 |
| 6 | 600 | 1800 | 1080000 |
| 7 | 610 | 3000 | 1830000 |
| 8 | 620 | 4500 | 2790000 |
| 9 | 630 | 6000 | 3780000 |
| 10 | 640 | 9000 | 5760000 |
| 11 | 650 | 11100 | 7215000 |
| 12 | 660 | 11400 | 7524000 |
| 13 | 670 | 11100 | 7437000 |
| 14 | 680 | 10000 | 6800000 |
| 15 | 690 | 9000 | 6210000 |
| 16 | 700 | 8500 | 5950000 |
| 17 | 710 | 8300 | 5893000 |
| 18 | 720 | 7900 | 5688000 |
| 19 | 730 | 7000 | 5110000 |
| 20 | 740 | 6000 | 4440000 |
| 21 | 750 | 5000 | 3750000 |
| 22 | 760 | 3500 | 2660000 |
| 23 | 770 | 2500 | 1925000 |
| 24 | 780 | 1900 | 1482000 |
| 25 | 790 | 1300 | 1027000 |
| 26 | 800 | 1000 | 800000 |
| 27 | 810 | 700 | 567000 |
| 28 | 820 | 500 | 410000 |
| 29 | 830 | 300 | 249000 |
| 30 | 840 | 50 | 42000 |
| 31 | 850 | 0 | 0 |
| TOTAL | | 133170 | 91482200 |

| CENTROID WAVELENGTH | Σpi×λi/Σpi= | 687 nm |
|---|---|---|

IMAGE FORMING DEVICE AND IMAGE FORMING METHOD

BACKGROUND

1. Technical Field

The present invention relates to an image forming device and an image forming method, which are provided to form a latent image by exposing a photoreceptor to light emitted by a light emitting element.

2. Related Art

Image forming devices have been proposed, which form a latent image on a photoreceptor by using an effect in which the potential of the photoreceptor is changed by exposure of the photoreceptor to light. For example, in an image forming device described in JP-A-2008-238633, an exposure head that has light emitting elements arranged in a predetermined direction faces a photoreceptor. The surface of the photoreceptor is irradiated with light emitted by the light emitting elements. The light forms spots on the surface of the photoreceptor. The potentials of portions (of the surface of the photoreceptor) that are irradiated with the light are changed. In this case, the potentials of the portions that correspond to a latent image to be formed are changed by the irradiation with the light so that the latent image is formed on the surface of the photoreceptor. The image forming device causes toner to be attached to the formed latent image so that the latent image is developed into a visible image.

The amount of the toner that is attached to the latent image for the development depends on the amount of the change in the potential of the surface of the photoreceptor. Thus, in order to form an excellent image, it is important to accurately control the amount of the change (due to the irradiation with the light emitted by the light emitting element) in the potential of the surface of the photoreceptor. When the amount of the change in the potential is significantly different from a predetermined amount of change, toner with an appropriate amount cannot be attached to the surface of the photoreceptor. As a result, the density of the image is largely different from an appropriate density, and a desired image cannot be formed.

However, a variation in the spectral distribution of each of the light emitting elements and spectral characteristics of the photoreceptor may cause a problem when the amount of the change in the potential of the photoreceptor is controlled. Since the manufacturing accuracy of the light emitting elements is limited, it is difficult to make the spectral distributions of all the manufactured light emitting elements the same. The spectral distributions of some of the light emitting elements may be shifted in the direction of the axis that indicates the wavelength of light emitted by the light emitting elements, or the shapes of the spectral distributions may be changed. On the other hand, the spectral sensitivity of the photoreceptor is not constant and is changed depending on the wavelength of light with which the photoreceptor is irradiated. When the spectral distributions of the light emitting elements vary, the sensitivity of the photoreceptor to the light emitted by the light emitting elements may also vary. As a result, the amounts of changes in the potentials of portions of the photoreceptor may vary. Thus, when the spectral distributions of the light emitting elements vary, the amounts of the changes in the potentials of the portions of the photoreceptor may vary. The amounts of the changes in the potentials of the portions of the photoreceptor may not be stabilized due to variations in the spectral distributions of the light emitting elements and variations in the spectral sensitivity of the photoreceptor. As a result, an excellent image may not be formed.

SUMMARY

An advantage of some aspects of the invention is that it provides a technique for stabilizing the amount of a change (due to irradiation with light emitted by a light emitting element) in the potential of a photoreceptor and forming an excellent image.

According to a first aspect of the invention, an image forming device includes: an exposure head that includes a light emitting element and a light emission controller that causes the light emitting element to emit light on the basis of a control signal; a photoreceptor that is exposed to the light emitted by the light emitting element included in the exposure head so that a latent image is formed on the photoreceptor; a correcting section that corrects the control signal on the basis of the spectral sensitivity of the photoreceptor to a spectral distribution of the light emitting element; and a developing section that develops the latent image formed on the photoreceptor.

According to a second aspect of the invention, an image forming method includes: correcting, on the basis of the spectral sensitivity of a photoreceptor to a spectral distribution of a light emitting element, a control signal that controls light emission of the light emitting element; exposing the photoreceptor to light that has been emitted by the light emitting element on the basis of the corrected control signal and forming a latent image on the photoreceptor; and developing the formed latent image.

According to the invention (image forming device and image forming method), the photoreceptor is exposed to the light that has been emitted by the light emitting element on the basis of the control signal so that the potential of a portion irradiated with the light is changed and a latent image is formed. In the aforementioned conventional technique, the amount of a change in the potential of the photoreceptor is not stable due to a variation in the spectral distribution of the light emitting element and a spectral sensitivity of the photoreceptorspectral sensitivity of the photoreceptor in some cases. According to the aspects of the invention, the control signal is corrected on the basis of the spectral sensitivity of the photoreceptor to the spectral distribution of the light emitting element and the light emitting element emits light on the basis of the corrected control signal (correcting section, and the correcting and exposing steps). As a result, the amount of a change in the potential of the photoreceptor can be stabilized against a variation in the spectral distribution of the light emitting element and a spectral sensitivity of the photoreceptorspectral sensitivity of the photoreceptor, and an excellent image can be formed.

According to a third aspect of the invention, in the image forming device according to the first aspect of the invention, it is preferable that the correcting section correct the control signal on the basis of the spectral sensitivity of the photoreceptor to light with a centroid wavelength calculated on the basis of the spectral distribution. The centroid wavelength tends to be changed on the basis of the variation in the spectral distribution. Thus, the control signal, which is to be applied to the light emitting element, is corrected on the basis of the spectral sensitivity of the photoreceptor to the light with the centroid wavelength. Therefore, the amount of a change in the potential of the photoreceptor can be stabilized against the variation in the spectral distribution of the light emitting element and a spectral sensitivity of the photoreceptor.

The amount of the light that is emitted by the light emitting element is changed due to the temperature of the light emitting element and degradation of the light emitting element in some cases. The change in the amount of the light emitted by the light emitting element may affect the amount of the change in the potential of the photoreceptor. According to the third aspect of the invention, it is preferable that the image forming device include a detector that detects the amount of the light emitted by the light emitting element, and the correcting section calculate a first correction value on the basis of the results of the detection performed by the detector, calculate the spectral sensitivity of the photoreceptor to the light with the centroid wavelength as a second correction value, and corrects the control signal on the basis of the first and second correction values. Thus, the amount of the change in the potential of the photoreceptor can be stabilized against the variation in the spectral distribution of the light emitting element, the spectral sensitivity of the photoreceptor, the temperature of the light emitting element and degradation of the light emitting element.

According to a fourth aspect of the invention, in the image forming device according to the third aspect of the invention, it is preferable that the correcting section correct the control signal on the basis of the spectral sensitivity of the photoreceptor to light with a wavelength that corresponds to a peak light intensity in the spectral distribution. The wavelength that corresponds to the peak light intensity tends to be changed on the basis of the variation in the spectral distribution. Thus, the control signal, which is to be applied to the light emitting element, is corrected on the basis of the spectral sensitivity of the photoreceptor to the light with the wavelength that corresponds to the peak light intensity. Therefore, the amount of the change in the potential of the photoreceptor can be stabilized against the variation in the spectral distribution of the light emitting element and the spectral sensitivity of the photoreceptor.

According to the fourth aspect of the invention, in order to stabilize the amount of the change in the potential of the photoreceptor against the temperature of the light emitting element and degradation of the light emitting element, it is preferable that the image forming device include a detector that detects the amount of the light emitted by the light emitting element, and the correcting section calculate a first correction value on the basis of the results of the detection performed by the detector, calculate, as a third correction value, the spectral sensitivity of the photoreceptor to the light with the wavelength corresponding to the peak light intensity, and correct the control signal on the basis of the first and third correction values.

BRIEF DESCRIPTION OF THE DRAWINGS

The invention will be described with reference to the accompanying drawings, wherein like numbers reference like elements.

FIG. 8 is a table showing an example of one of measured spectral distributions.

DESCRIPTION OF EXEMPLARY EMBODIMENTS

First Embodiment

Figure 1:
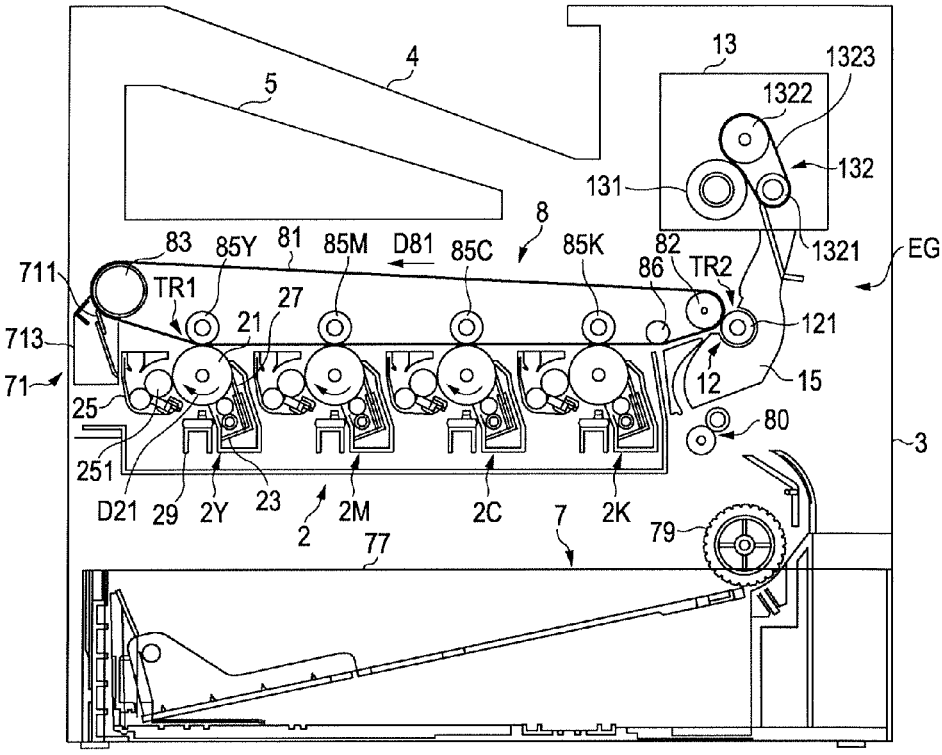
FIG. 1 is a diagram showing an image forming device according to an embodiment of the invention.
Figure 2:
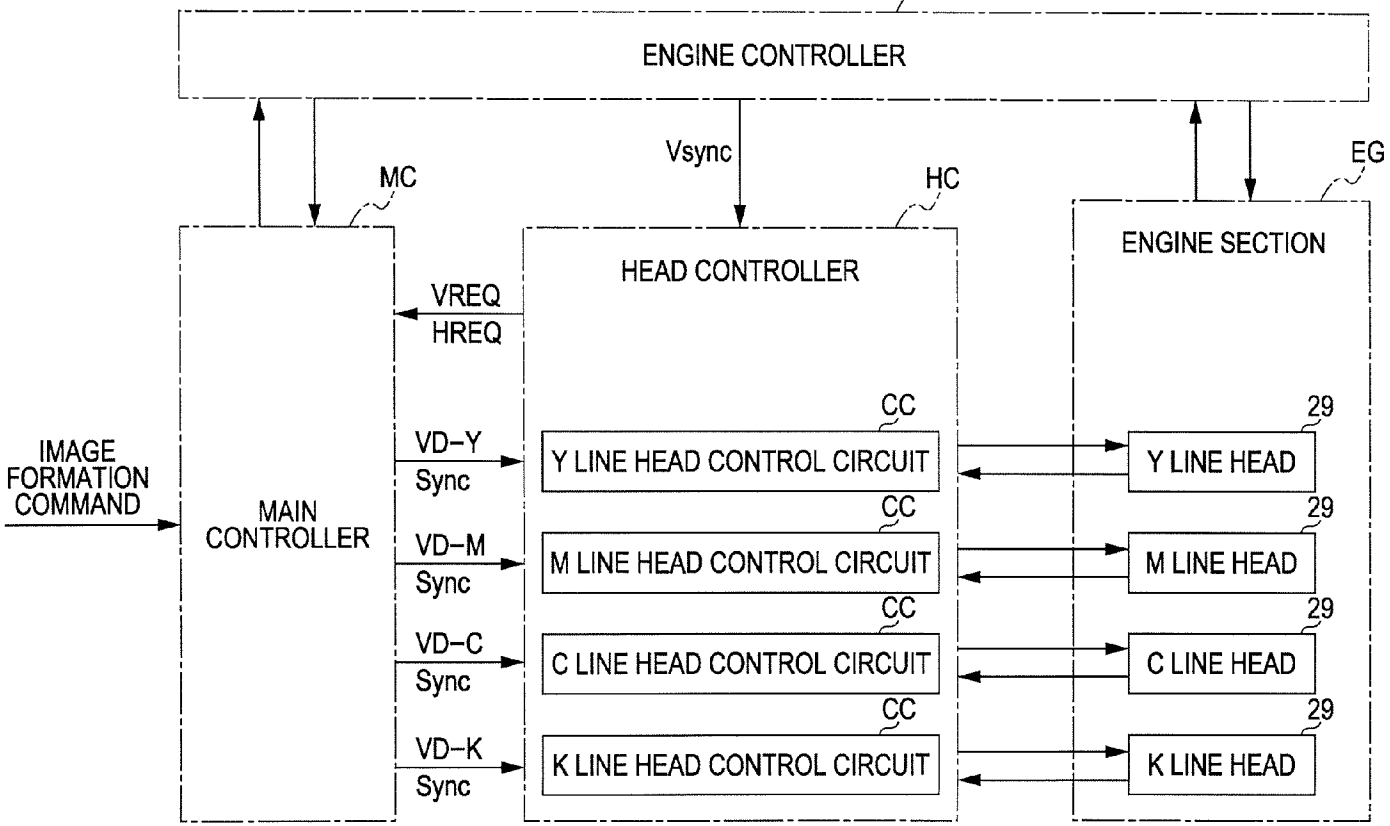
FIG. 2 is a block diagram showing an electrical configuration of the image forming device shown in FIG. 1.

FIG. 1 is a diagram showing an image forming device according to an embodiment of the invention. FIG. 2 is a block diagram showing an electric configuration of the image forming device shown in FIG. 1. The image forming device is capable of selectively performing a color mode and a monochromatic mode. In the color mode, the image forming device forms a color image by superimposing toner images of four colors (yellow (Y), magenta (M), cyan (C) and black (K)). In the monochromatic mode, the image forming device uses only black toner to form a monochromatic image. When a main controller MC that has a CPU and a memory and is included in the image forming device receives an image formation command from an external device such as a host computer, the main controller MC transmits a control signal to an engine controller EC. The engine controller EC controls, on the basis of the control signal, an engine section EG, a head controller HC and the like of the image forming device to cause the image forming device to perform a predetermined image forming operation. Then, the image forming device performs the predetermined image forming operation to form an image on a printing sheet (such as a copy paper sheet, a transfer paper sheet, a normal paper sheet, or an OHP transparent sheet) according to the image formation command.

The image forming device according to the present embodiment has a housing body 3. An electrical component box 5 is contained in the housing body 3. The electrical component box 5 contains a power supply circuit substrate, the main controller MC, the engine controller EC, and the head controller HC. The housing body 3 also contains an image forming unit 2, a transfer belt unit 8, and a sheet feeding unit 7. As shown in FIG. 1, a secondary transfer unit 12, a fixing unit 13 and a sheet guiding member 15 are included in the housing body 3 and located on the right side of the housing body 3. The sheet feeding unit 7 is removable from and attachable to the housing body 3. The sheet feeding unit 7 and the transfer belt unit 8 can be removed from the housing body 3 and repaired or replaced with other units.

The image forming unit 2 has four image forming stations 2Y (for yellow), 2M (for magenta), 2C (for cyan) and 2K (for black), which form images of different colors, respectively. Referring to FIG. 1, the image forming stations 2Y, 2M, 2C and 2K have the same configuration. Thus, some reference numerals are shown only for the image forming station 2Y for convenience of illustration and are not shown for the other image forming stations.

The image forming stations 2Y, 2M, 2C and 2K each include a photosensitive drum 21. The image forming station 2Y forms a yellow toner image on a surface of the photosensitive drum 21 included in the image forming station 2Y. The image forming station 2M forms a magenta toner image on a surface of the photosensitive drum 21 included in the image forming station 2M. The image forming station 2C forms a cyan toner image on a surface of the photosensitive image 21 included in the image forming station 2C. The image forming station 2K forms a black toner image on a surface of the photosensitive image 21 included in the image forming station 2K. Each of the photosensitive drums 21 has a rotational axis parallel to or substantially parallel to a main scanning direction MD (perpendicular to the surface of the paper sheet of FIG. 1). The photosensitive drums 21 are connected to dedicated drive motors, respectively. Each of the photosensitive drums 21 is driven to rotate at a predetermined rotation rate in a rotational direction D21 (shown by an arrow of FIG. 1) by the dedicated drive motor. Thus, the surfaces of the photosensitive drums 21 move in the rotational direction D21. Each of the image forming stations 2Y, 2M, 2C and 2K includes a charger 23, a line head 29, a developer 25 and a photosensitive drum cleaner 27, which are located at the periphery of the photosensitive drum 21 included in the image forming station and are arranged in the rotational direction of the photosensitive drum 21. The charger 23 included in each of the image forming stations charges the surface of the photosensitive drum 21 included in the image forming station. The line head 29 included in each of the image forming stations forms a latent image on the surface of the photosensitive drum 21 included in the image forming station. The developer 25 included in each of the image forming stations develops, into a toner image, the latent image formed on the surface of the photosensitive drum 21 included in the image forming station. In the color mode, the image forming device superimposes the toner images formed by the image forming stations 2Y, 2M, 2C and 2K onto a transfer belt 81 (included in the transfer belt unit 8) to form a color image. In the monochromatic mode, the image forming device operates only the image forming station 2K to form a black image (monochromatic image).

Each of the chargers 23 includes a charging roller that has a surface made of elastic rubber. The charging roller included in each of the image forming stations comes in contact with the surface of the photosensitive drum 21 included in the image forming station and is rotated by the rotation of the photosensitive drum 21. Each of the charging rollers is connected to a charging bias generator (not shown). The charging bias generator supplies a charging bias to each of the charging rollers. Then, the charging roller included in each of the image forming stations receives the charging bias and charges the surface of the photosensitive drum 21 included in the image forming station to a predetermined surface potential at the contact point of the charging roller and the photosensitive drum 21.

Each of the line heads 29 is arranged so that a longitudinal direction LGD (shown in FIG. 3) of the line head 29 is parallel to or substantially parallel to the main scanning direction MD and that a lateral direction LTD (shown in FIG. 3) of the line head 29 is parallel to or substantially parallel to an auxiliary scanning direction SD that is perpendicular to or substantially perpendicular to the main scanning direction MD. Each of the line heads 29 has a plurality of light emitting elements E that are arranged in the longitudinal direction LGD. The light emitting elements E included in each of the image forming stations is arranged opposite the photosensitive drum 21 included in the image forming station. The light emitting elements E included in each of the image forming stations emit light to the surface of the photosensitive drum 21 charged by the charger 23 included in the image forming station so that an electrostatic latent image is formed on the surface of the photosensitive drum 21.

Figure 3:
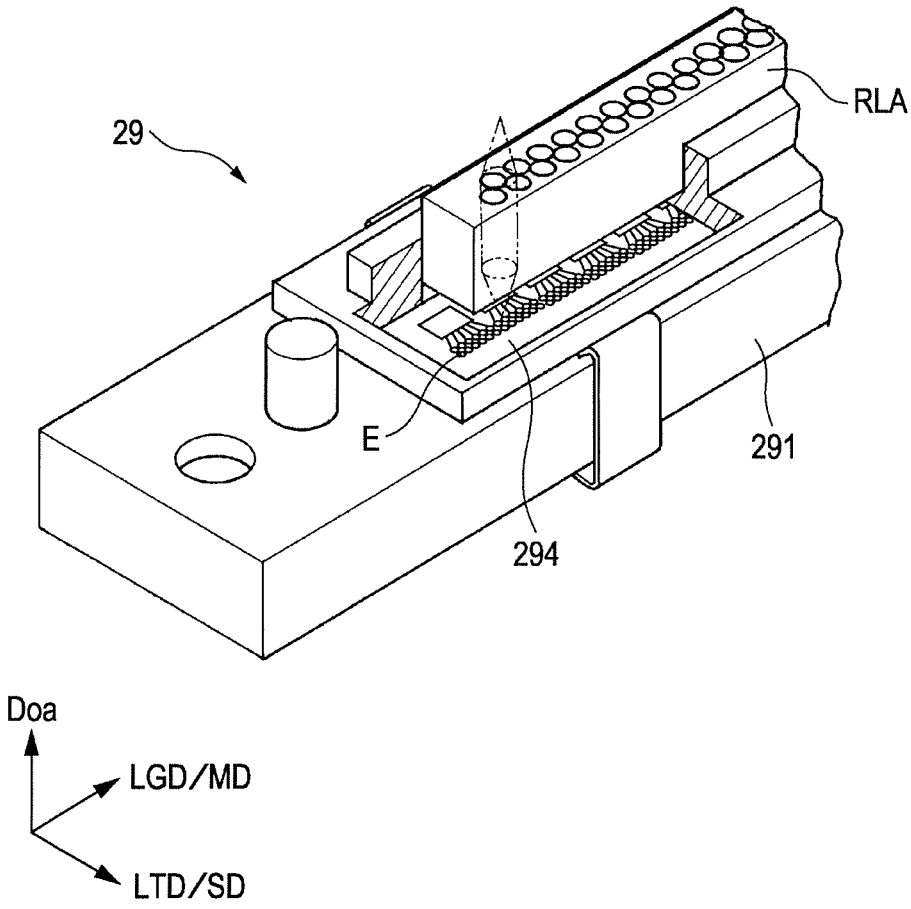
FIG. 3 is a perspective view of the structure of a line head.
Figure 4:
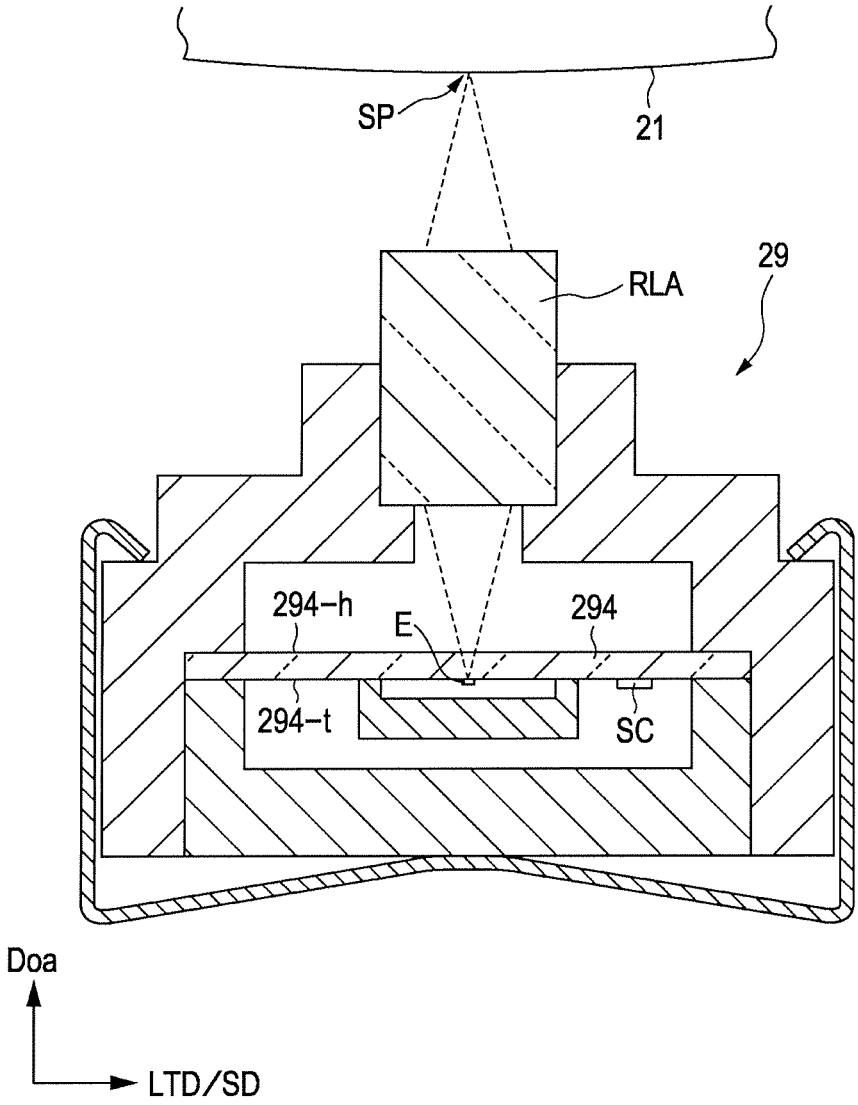
FIG. 4 is a partial cross-sectional view of the structure of the line head.

FIG. 3 is a perspective view of the structure of one of the line heads 29. Each of the line heads 29 has a head substrate 294. FIG. 3 illustrates a back surface of the head substrate 294, and does not illustrate a front surface of the head substrate 294. The front surface of the head substrate 294 is located on the upper side of FIG. 3, while the back surface of the head substrate 294 is located on the lower side of FIG. 3. FIG. 4 is a partial cross-sectional view of a structure of one of the line heads 29. In FIGS. 3 and 4, the direction (between the line head 29 and the photosensitive drum 29) in which light is emitted by the light emitting elements E is perpendicular to the main scanning direction MD and the auxiliary scanning direction SD and is represented by Doa.

Each of the line heads 29 includes a body 291 and the head substrate 294 that is included in the body 291 and made of glass. The light emitting elements E are arranged in two rows in the main scanning direction MD (longitudinal direction LGD) in a zigzag pattern on the back surface 294-*t* of each of the head substrates 294. The light emitting elements E are bottom emission type organic electroluminescence elements. A driving current is applied to each of the light emitting elements E so that the light emitting element E emits light.

An optical sensor SC is provided on the back surface 294-*t* of each of the head substrates 294 (refer to FIG. 4). Each of the optical sensors SC detects changes (due to changes in the temperatures of the light emitting elements E or degradation of the light emitting elements E) in the amounts of light emitted by the light emitting elements. The values of the driving currents that are to be applied to the light emitting elements E are corrected on the basis of the results of the detection performed by the optical sensors SC.

A refractive index distribution type rod lens array RLA (hereinafter abbreviated as lens array RLA), which is included in each of the line heads 29, faces the light emitting elements E (arranged on the back surface 294-*t* of the head substrate 294) from the side of the front surface 294-*h* of the head substrate 294. The light that is emitted by the light emitting elements E from emitting surfaces of the light emitting elements E passes through the head substrate 294 and is incident on the lens array RLA. Upright and unmagnified images are formed by the lens array RLA so that spots SP are formed on the surface of the photosensitive drum 21. Portions of the surface of the photosensitive drum 21, on which the spots SP are formed, are exposed to the light so that an electrostatic latent image is formed on the surface of the photosensitive drum 21.

Returning to FIG. 1, the configuration of the image forming device is described below. Each of the developers 25 has a developing roller 251. Each of the developing rollers 251 has toner on the surface of the developing roller 251 and is electrically connected to a developing bias generator (not shown). The developing bias generator applies a developing bias to each of the developing rollers 251. When the developing roller 251 receives the developing bias, charged toner moves from the developing roller 251 to the photosensitive drum 21 through a contact point of the developing roller 251 and the photosensitive drum 21. The electrostatic latent image formed on the surface of the photosensitive drum 21 is made visible by the toner.

Each of the photosensitive drums 21 transports the visible toner image in the rotational direction D21 of the photosensitive drum 21. After that, the visible toner image formed on each of the photosensitive drums 21 is primarily transferred to the transfer belt 81 at a contact point TR1 of the transfer belt 81 and the photosensitive drum 21.

In each of the image forming stations, the photosensitive drum cleaner 27 is arranged so that the surface of the photosensitive drum 21 moves from the contact point TR1 through the photosensitive drum cleaner 27 to the charger 23. The photosensitive drum cleaner 27 is in contact with the surface of the photosensitive drum 21. Thus, the photosensitive drum cleaner 27 removes toner from the surface of the photosensitive drum 21 after the primary transfer.

The transfer belt unit 8 includes a drive roller 82, a driven roller (blade opposing roller) 83 and the transfer belt 81. The driven roller 83 is located on the left side of the drive roller 82 as shown in FIG. 1. The transfer belt 81 is stretched between the rollers 82 and 83. The transfer belt 81 is driven by rotation of the drive roller 82 to move in a direction (transport direction) D81 shown by an arrow (shown in FIG. 1). The transfer belt unit 8 also has four primary transfer rollers 85Y, 85M, 85C and 85K, which are located on an inner side of the transfer belt 81. The primary transfer rollers 85Y, 85M, 85C and 85K are arranged opposite the photosensitive drums 21 (included in the image forming stations 2Y, 2M, 2C and 2K), respectively, under the condition that cartridges are set. The primary transfer rollers 85Y, 85M, 85C and 85K are each electrically connected to a primary transfer bias generator (not shown).

In the color mode, the primary transfer rollers 85Y, 85M, 85C and 85K are positioned on the sides of the image forming stations 2Y, 2M, 2C and 2K to press the transfer belt 81 and allow the transfer belt 81 to be in contact with the photosensitive drums 21 included in the image forming stations 2Y, 2M, 2C and 2K at the contact points TR1 of the photosensitive drums 21 and the transfer belt 81, as shown in FIG. 1. Then, the primary transfer bias generators apply primary transfer biases to the primary transfer rollers 85Y, 85M, 85C and 85K at appropriate times to ensure that the toner images formed on the respective surfaces of the photosensitive drums 21 are transferred to an outer surface of the transfer belt 81 at the contact points TR1. In the color mode, the image forming device superimposes the monochromatic toner images of yellow, magenta, cyan and black colors onto the transfer belt 81 to form a color image.

The transfer belt unit 8 also has a downstream guide roller 86. The downstream guide roller 86 is arranged so that the surface of the transfer belt 81 moves from the primary transfer roller 85K (for black) through the downstream guide roller 86 to the drive roller 82. The downstream guide roller 86 is in contact with the transfer belt 81 on a tangent of the primary transfer roller 85K. The tangent of the primary transfer roller 85K is drawn from the contact point TR1 of the transfer belt 81 and the photosensitive drum 21 included in the image forming station 2K.

The sheet feeding unit 7 has a sheet feeding section. The sheet feeding section has a sheet feeding cassette 77 and a pickup roller 79. The sheet feeding cassette 77 is capable of holding stacked sheets. The pickup roller 79 feeds the stacked sheets one by one from the sheet feeding cassette 77. After each sheet output from the sheet feeding cassette 77 by the pickup roller 79 reaches a pair of resist rollers 80, the pair of resist rollers 80 adjusts the timing for feeding the sheet. After the adjustment of the timing for feeding each sheet, the sheet moves along the sheet guiding member 15 and reaches a contact point TR2 of the drive roller 82 and a secondary transfer roller 121.

The secondary transfer roller 121 is capable of being separated from the transfer belt 81 and of contacting the transfer belt 81. The secondary transfer roller 121 is driven by a secondary transfer roller driving mechanism (not shown) so as to be separated from the transfer belt 81 and so as to contact the transfer belt 81. The fixing unit 13 has a heating roller 131 and a pressing section 132. The heating roller 131 has a heating element (such as a halogen heater) therein and is rotatable. The pressing section 132 presses and urges the heating roller 131. The pressing section 132 has a pressure belt 1323. The heating roller 131 and the pressure belt 1323 form a nip portion. Each sheet on which an image is secondarily transferred at the contact point TR2 is guided to the nip portion by the sheet guide member 15. The secondarily transferred image is thermally fixed at a predetermined temperature by the nip portion. The pressing section 132 includes two rollers 1321, 1322 and the pressure belt 1323. The pressure belt 1323 is stretched between the two rollers 1321 and 1322. The surface of the pressure belt 1323 stretched by the two rollers 1321 and 1322 is pressed against a circular surface of the heating roller 131 so that the nip portion is large. Each sheet subjected to the fixing process is fed to a paper receiving tray 4 that is installed in an upper surface portion of the housing body 3.

The drive roller 82 drives the transfer belt 81 to cause the transfer belt 81 to move in the direction D81. The drive roller 82 serves as a backup roller for the secondary transfer roller 121. The drive roller 82 has a rubber layer on a circular surface of the drive roller 82. The rubber layer has a thickness of approximately 3 mm and a volume resistivity of 1000 KΩ·cm or less. The rubber layer is grounded through a metal shaft and serves as a conductive path for a secondary transfer bias. The secondary transfer bias is supplied from a secondary transfer bias generator (not shown) through the secondary transfer roller 121 to the drive roller 82. The rubber layer has a high frictional property and a high shock absorption property. Thus, the rubber layer prevents the quality of the image formed on the transfer belt 81 from being degraded due to transfer of a shock (that occurs when the sheet reaches the contact point TR2) to the transfer belt 81.

The image forming device has a cleaner 71 arranged opposite the blade opposing roller 83. The cleaner 71 has a cleaner blade 711 and a toner disposal box 713. The cleaner blade 711 has an edge portion that indirectly contacts the blade opposing roller 83 through the transfer belt 81. The edge portion of the cleaner blade 711 removes toner, paper powder, foreign materials and the like (that remain on the transfer belt 81 after the secondary transfer) from the transfer belt 81 by indirectly contacting the blade opposing roller 83 through the transfer belt 81. The removed foreign materials and the like are collected in the toner disposal box 713. The cleaner blade 711, the toner disposal box 713 and the blade opposing roller 83 form an integrated unit.

In the present embodiment, the photosensitive drum 21, the charger 23, the developer 25 and the photosensitive drum cleaner 27, which are included in each of the image forming stations 2Y, 2M, 2C and 2K, form one of the aforementioned cartridges. The four cartridges are removable from and attachable to the image forming device. Each of the cartridges has a nonvolatile memory that stores information on the cartridge. Each of the cartridges wirelessly communicates with the engine controller EC. The wireless communication allows each of the cartridges to transmit the information on the cartridge to the engine controller EC, and allows information stored in the memory of the cartridge to be updated. Each of the cartridges stores the updated information in the memory of the cartridge. In addition, the wireless communication allows use history of each of the cartridges and life expectancies of consumable supplies to be managed on the basis of the information on each of the cartridges.

The outline configuration of the image forming device is described above. In the following, it is described that the image forming device according to the present embodiment performs light emission control so that the light emitting elements emit light. The light emission control is performed by line head control circuits CC that are installed in the head controller HC (refer to FIG. 2). The line head control circuits CC (Y line head control circuit, M line head control circuit, C line head control circuit and K line head control circuit) are provided for yellow, magenta, cyan and black colors, respectively. The configuration and operations of each of the line head circuits CC are described below. The configuration and operations of each of the line head circuits CC for yellow, magenta, cyan and black colors are the same as or similar to the other line head circuits CC. Thus, the Y line head control circuit CC for yellow is described as an example.

Figure 5:
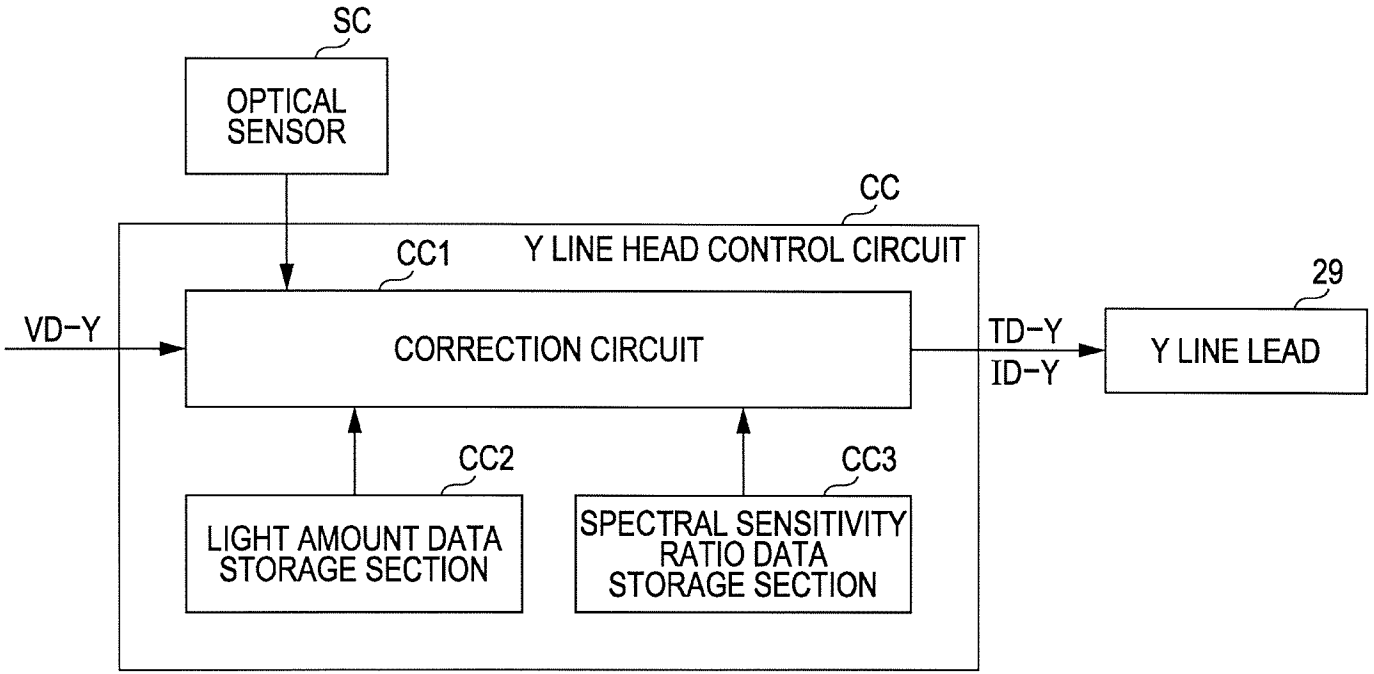
FIG. 5 is a block diagram showing the configuration of a Y line head control circuit.

FIG. 5 is a block diagram showing the configuration of the Y line head control circuit CC. The Y line head control circuit CC includes a correction circuit CC1, a light amount correction data storage section CC2 and a spectral sensitivity ratio data storage section CC3. The Y line head control circuit CC generates data TD-Y (data signal) (that indicates a time period for which each of the light emitting elements E emits light) and a driving current value ID-Y (current value signal) (that indicates the value of a driving current that is to be supplied to each of the light emitting elements E) on the basis of video data VD-Y (for yellow) and the like that have been transmitted from the main controller MC.

The light amount correction data storage section CC2 corrects, on the basis of the results of detection performed by the optical sensor SC, the amounts (changed due to changes in the temperatures of the light emitting elements E or degradation of the light emitting elements E) of light that is to be emitted by the light emitting elements E. The light amount correction data storage section CC2 and the correction circuit CC1 operate together to correct the amounts of the light. As described above, in the present embodiment, the surface of the photosensitive drum 21 is irradiated with light emitted by the light emitting elements E, and the potentials of the portions (of the surface of the photosensitive drum 21) irradiated with the light are changed so that an electrostatic latent image is formed on the surface of the photosensitive drum 21. In this case, the amounts of the changes in the potentials of the portions of the surface of the photosensitive drum 21 depend on the amounts of the light emitted by the light emitting elements E. Thus, when the amount of the light emitted by a certain one of the light emitting elements E is changed due to the temperature of the light emitting element E or degradation of the light emitting element E, the amount of the change in the potential of the portion irradiated with the light may be different from a desired value. Thus, an appropriate image cannot be formed in some cases. In order to avoid this problem, the following light amount correction is performed.

First, parameters that are necessary to correct the amounts of light (to be emitted by the light emitting elements) are measured before shipment of the line head 29 from a factory. Specifically, before the shipment from the factory, the line head 29 is attached to a jig (light amount measurement jig) for measurement of the amounts of light in order for an optical amount detector to detect the amount of light emitted by each of the light emitting elements E. The light amount measurement jig causes each of the light emitting elements E (arranged in the main scanning direction MD) to sequentially emit light so that the light amount detector detects the amounts Pg(1), Pg(2), . . . , and Pg(n) of light emitted by the light emitting elements E(1), E(2), . . . , and E(n) and stores the detected amounts Pg(1), Pg(2), . . . , and Pg(n). While the light amount detector performs the operation for storing the detected amounts, the light amount measurement jig stores the amounts Ph(1), Ph(2), . . . , and Ph(n) of the light detected by the optical sensor SC of the line head 29 during the time when the light emitting elements E sequentially emit light. A light amount correction factor Pg(n)/Ph(n) is calculated from the detected parameters Pg(n) and Ph(n) for each of the light emitting elements E. The line head 29 is shipped with the light amount correction factor Pg(n)/Ph(n) stored in the light amount correction data storage section CC2.

The values that are added to indicate the light emitting elements E and shown in the parentheses are identification numbers of the light emitting elements E. The identification numbers are added in the order of the arrangement of the light emitting elements E to indicate the light emitting elements E arranged in the main scanning direction. The amount Pg(n) indicates the amount of the light detected by the light amount detector of the light amount measurement jig, while the amount Ph(n) indicates the amount of the light detected by the optical sensor SC of the line head 29. The same applies to parameters (parameter Pj(n) and the like) that have identification numbers in parentheses and are described below.

After the shipment of the line head 29, the amount of light that is to be emitted by each of the light emitting elements E is corrected when electric power is supplied to the image forming device or during the time when the image forming device forms an image. Specifically, in the process of correcting the amounts of light, the correction circuit CC1 causes the light emitting elements E to sequentially emit light, and the optical sensor SC detects the amounts Pj(1), Pj(2), . . . , and Pj(n) of the light emitted by the light emitting elements E(1), E(2), . . . , and E(n) and stores the detected amounts. The correction circuit CC1 estimates the amount of the light emitted by each of the light emitting elements E(n) by regarding a value (Pj(n)×Pg(n)/Ph(n)) (obtained by multiplying the amount Pj(n) of the light detected by the optical sensor SC by the light amount correction coefficient Pg(n)/Ph(n)) as the actual amount of the light emitted by the light emitting element E(n).

Since the actual amount (Pj(n)×Pg(n)/Ph(n)) of the light emitted by the light emitting element E(n) can be estimated, an amount (correction amount) that is necessary to correct the amount of light that is to be emitted by the light emitting element E(n) is calculated by comparing the estimated amount with a target amount. Then, the value of the driving current that is to be supplied to the light emitting element E(n) is calculated so that the amount of the light that is to be emitted by the light emitting element E(n) is corrected only by means of the correction amount (light amount correction).

The amount of a change in the potential of a portion (of the surface of the photosensitive drum 21) irradiated with the light emitted by each of the light emitting elements E depends on the amount of the light emitted by the light emitting element E and the spectral sensitivity of the photosensitive drum 21. However, as described in Japanese Patent No. 4115253, the spectral sensitivity of a general photoreceptor is changed on the basis of the wavelength of light with which the photoreceptor is irradiated (refer to FIG. 6).

Figure 6:
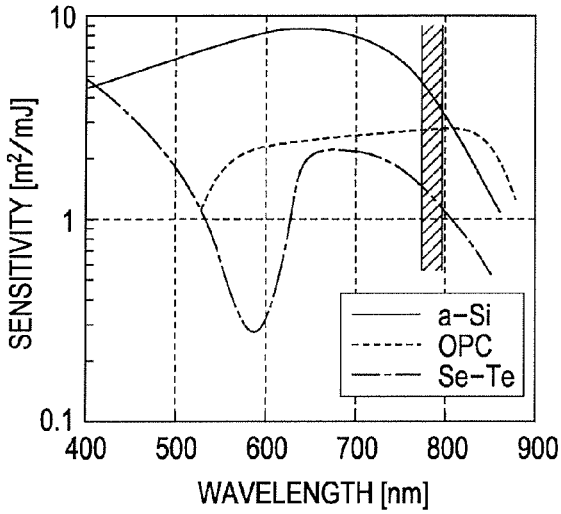
FIG. 6 is a graph showing an example of spectral sensitivity of a photoreceptor.

FIG. 6 is a graph showing an example of the spectral sensitivity of photoreceptors. The abscissa indicates the wavelength of light, while the ordinate indicates spectral sensitivity ($m^2$/mJ). FIG. 6 shows the spectral sensitivity of the photoreceptor made of amorphous silicon (a-Si), the spectral sensitivity of the photoreceptor made of a selenium-tellurium alloy, and the spectral sensitivity of the photoreceptor made of an organic photo conductor (OPC). It is apparent that the spectral sensitivity of each of the photoreceptors is changed on the basis of the wavelength of light with which the photoreceptor is irradiated. The following describes the spectral sensitivity of the photoreceptor made of OPC as an example. For wavelengths that are close to 700 nm, the longer the wavelength, the more excellent the spectral sensitivity of the photoreceptor made of OPC and the lower the energy with which the potential of the photoreceptor is changed (or the lower the energy with which a latent image is formed). For example, two light emitting elements E that exhibit different spectral distributions are compared with each other. Even when the amounts (that correspond to values obtained by integrating the intensities of light emitted by the two light emitting elements E over the wavelength range of the light) of the light emitted by the two light emitting elements E are the same, the light emitting element E, which exhibits the spectral distribution that includes more light components with long wavelengths than the spectral distribution of the other light emitting element E, can change the potential of a portion of the photoreceptor more greatly than the other light emitting element E. Thus, when the amounts of light that is to be emitted by the light emitting elements E are corrected, and the spectral distributions of the light emitting elements E vary, the amounts of changes in potentials of the portions of the photoreceptor also vary. As a result, an excellent image may not be formed.

In order to avoid this problem, each of the line head control circuits CC according to the present embodiment includes the spectral sensitivity ratio data storage section CC3. In each of the head control circuits CC, the spectral sensitivity ratio data storage section CC3 and the correction circuit CC1 operate together to control light emission that is performed by the light emitting elements E.

Figure 7:
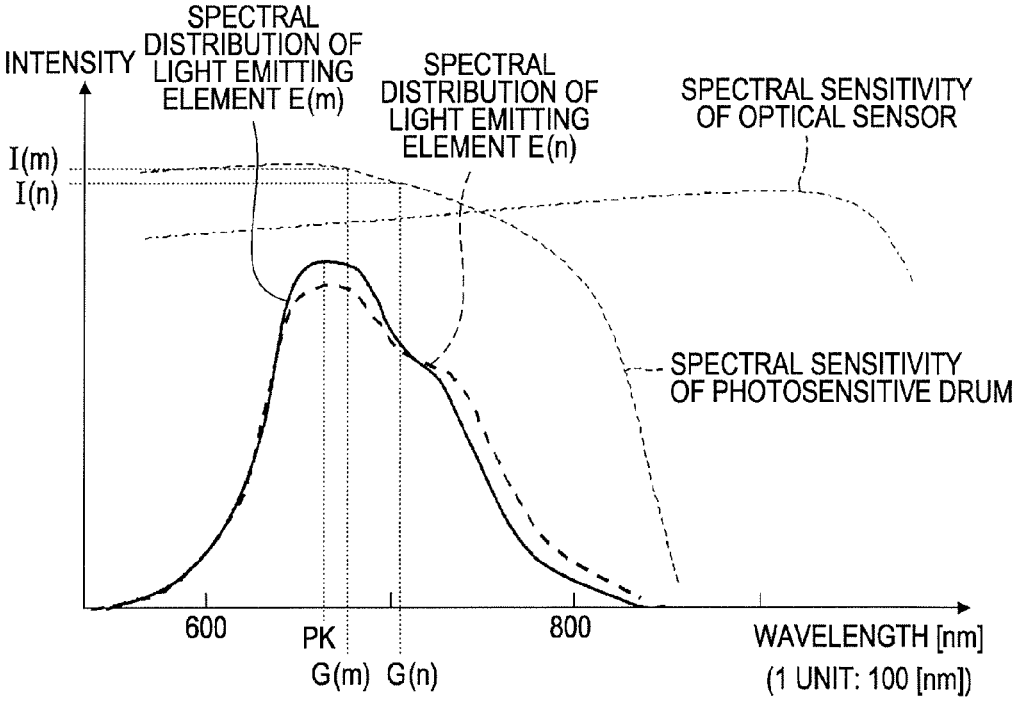
FIG. 7 is a graph showing light emission control that is performed by a spectral sensitivity ratio data storage section and a correction circuit.

FIG. 7 is a graph showing the light emission control that is performed by the spectral sensitivity ratio data storage section and the correction circuit. In the graph shown in FIG. 7, the abscissa indicates the wavelength (nm) of light, and the ordinate indicates the intensity of the light. In addition, FIG. 7 shows the spectral distribution of the light emitting element E(n), the spectral distribution of the light emitting element E(m), and the spectral sensitivity of the photosensitive drum 21 used in the present embodiment. The spectral sensitivity (shown in FIG. 7) of the photosensitive drum 21 is different from the spectral sensitivity (shown in FIG. 6) of the photoreceptors. FIG. 7 also shows the spectral sensitivity of the optical sensor SC. It is apparent that the spectral sensitivity of the optical sensor SC is relatively constant.

As shown in FIG. 7, it is apparent that the spectral sensitivity of the photosensitive drum 21 is not constant and is reduced when the photosensitive drum 21 is irradiated with light with a wavelength that is close to and less than 700 nm. For wavelengths that are longer than the wavelength that is close to and less than 700 nm, it is apparent that as the wavelength of light with which the photosensitive drum 21 is irradiated is longer, the spectral sensitivity of the photosensitive drum 21 is lower. Thus, as the spectral distribution of the light emitting element E includes more light components with long wavelengths, the amount of a change in the potential of the photosensitive drum 21 irradiated with the light emitted by the light emitting element E is smaller. In the example shown in FIG. 7, the spectral distribution of the light emitting element E(n) is different from the spectral distribution of the light emitting element E(m). A wavelength PK that corresponds to a peak light intensity in the spectral distribution of the light emitting element E(n) is substantially equal to a wavelength PK that corresponds to a peak light intensity in the spectral distribution of the light emitting element E(m). The spectral distribution of the light emitting element E(n) includes more light components with long wavelengths than the spectral distribution of the light emitting element E(m). Thus, the amount of a change in the potential of the photosensitive drum 21 irradiated with the light emitted by the light emitting element E(n) tends to be smaller than the amount of a change in the potential of the photosensitive drum 21 irradiated with the light emitted by the light emitting element E(m). In the present embodiment, the spectral sensitivity ratio data storage section CC3 and the correction circuit CC1 control the light emission (that is performed by each of the light emitting elements E) on the basis of the spectral distribution of the light emitting element E in order to suppress a variation (due to a variation in the spectral sensitivity) in the amount of a change in the potential of the photosensitive drum 21.

Parameters that are necessary to control the light emission are measured before the shipment of the line head 29 from the factory. Specifically, before the shipment from the factory, the line head 29 is attached to a jig (spectral distribution measurement jig) for measurement of spectral distributions in order for a spectroscope to measure spectral distributions of the light emitting elements E. The spectral distribution measurement jig causes the light emitting elements E arranged in the main scanning direction to sequentially emit light and measures the spectral distributions of the light emitting elements E(1), E(2), . . . , E(m), and E(n).

FIG. 8 is a table showing an example of one of the measured spectral distributions. As shown in the table, wavelengths of light emitted in order to measure the spectral distribution are in a range of 550 nm to 850 nm. This is because the spectral distribution is measured in the wavelength range (shown in FIG. 7) in which the intensities of the light are sufficiently low. In this case, when the spectroscope has wavelength resolution of 10 nm, 31 data pieces can be obtained. A centroid wavelength is calculated on the basis of the measured results (spectral distribution). Specifically, the centroid wavelength is expressed by the following formula.

$$\sum_{i=1}^{31} (Pi \times \lambda i) \Big/ \sum_{i=1}^{31} Pi \qquad \text{Formula 1}$$

In this manner, the centroid wavelengths G(1), G(2), . . . , G(m), and G(n) are calculated on the basis of the spectral distributions of the light emitting elements E(1), E(2), . . . , E(m), and E(n), respectively.

Figure 9:
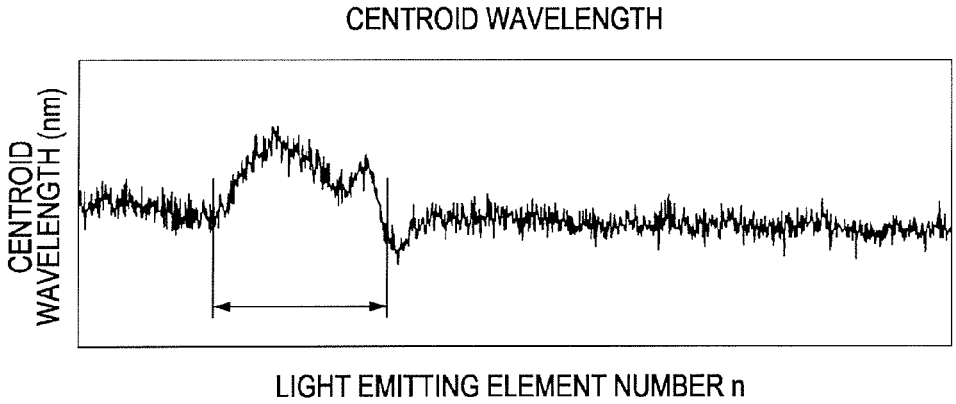
FIG. 9 is a graph showing an example of centroid wavelengths calculated on the basis of measured spectral distributions.

FIG. 9 is a graph showing an example of the centroid wavelengths of the measured spectral distributions. In the graph shown in FIG. 9, the abscissa indicates the number n of the light emitting element, and the ordinate indicates the centroid wavelength. As shown in FIG. 9, the centroid wavelengths that are included in a range shown by an arrow of FIG. 9 are long compared to other centroid wavelengths. The amounts of changes in potentials of the portions of the surface of the photosensitive drum 21 irradiated with light emitted by the light emitting elements E arranged in the range shown in FIG. 9 are small. A latent image formed by a light emitting element E that is located at a boundary of the range shown in FIG. 9 and exhibits a spectral distribution with a long centroid wavelength is adjacent to a latent image formed by a light emitting element E that is located at the boundary of the range shown in FIG. 9 and exhibits a spectral distribution with a short centroid wavelength. Thus, if latent images that are formed without consideration of variations in spectral distributions of the light emitting elements E were developed, a difference between gradations of the images formed by the light emitting elements E located at the boundary would be noticeable.

In the present embodiment, in order to avoid this problem, spectral sensitivity I(1), I(2), . . . , I(m), and I(n) of the photosensitive drum 21 to light with centroid wavelengths G(1), G(2), . . . , G(m), and G(n) is calculated. One of the light emitting elements E is selected as a reference light emitting element E(ref). The following ratios are calculated as spectral sensitivity ratio data: the ratio I(1)/I(ref) of the spectral sensitivity I(1) of the photosensitive drum 21 to light emitted by the light emitting element E(1) to the spectral sensitivity I(ref) of the photosensitive drum 21 to light emitted by the light emitting element E(ref); the ratio I(2)/I(ref) of the spectral sensitivity I(2) of the photosensitive drum 21 to light emitted by the light emitting element E(2) to the spectral sensitivity I(ref) of the photosensitive drum 21 to light emitted by the light emitting element E(ref); the ratio I(n)/I(ref) of the spectral sensitivity I(n) of the photosensitive drum 21 to light emitted by the light emitting element E(n) to the spectral sensitivity I(ref) of the photosensitive drum 21 to light emitted by the light emitting element E(ref); etc. The line head 29 is shipped from the factory under the condition that the spectral sensitivity ratio data I(1)/I(ref), I(2)/I(ref), . . . , and I(n)/I(ref) is stored in the spectral sensitivity ratio data storage section CC3.

In order for the line head 29 to form a latent image after the shipment of the line head 29, the correction circuits CC1 first controls light emission (that is performed by the light emitting elements E) on the basis of the spectral sensitivity ratio data stored in the spectral sensitivity ratio data storage section CC3. The driving current value ID-Y is calculated so that the light emitting element E(n) emits light with an amount that is obtained by multiplying the amount (Pj(n)×Pg(n)/Ph(n)) estimated on the basis of the value detected by the optical sensor SC by the spectral sensitivity ratio data I(n)/I(ref). The driving current with the value ID-Y is supplied to the light emitting element E(n) for a time period indicated by the data TD-Y generated on the basis of the video data VD-Y so that the light emitting element E(n) emits light. Since the light emission of each of the light emitting elements E is controlled, the amount of the change (due to the irradiation with light emitted by the light emitting element E) in the potential of the portion of the surface of the photosensitive drum 21 can be stabilized.

In the first embodiment, the driving current value (control signal) ID-Y is corrected on the basis of the spectral sensitivity of the photosensitive drum 21 to the spectral distribution of each of the light emitting elements E, and the light emitting element E emits light on the basis of the corrected driving current value ID-Y. As a result, the amounts of changes in the potentials of the portions of the surface of the photosensitive drum 21 can be stabilized against variations in the spectral distributions of the light emitting elements E and variations in the spectral sensitivity of the photosensitive drum 21. Therefore, an excellent image can be formed.

In the first embodiment, the driving current value ID-Y (control signal) is corrected on the basis of the spectral sensitivity of the photosensitive drum 21 to the spectral distribution of each of the light emitting elements E. Thus, the first embodiment is suitable for stabilizing the amounts of changes in the potentials of the portions of the photosensitive drum 21. Each of the centroid wavelengths calculated on the basis of the spectral distributions tends to vary depending on a variation in the spectral distribution. Thus, the value ID-Y (control signal) the driving current that is to be applied to each of the light emitting elements E is corrected on the basis of the spectral sensitivity of the photosensitive drum 21 to light with the centroid wavelength calculated on the basis of the spectral distribution. Therefore, the amounts of changes in the potentials of the portions of the photosensitive drum 21 can be stabilized against variations in the spectral distributions of the light emitting elements E and variations in the spectral sensitivity of the photosensitive drum 21.

In the first embodiment, the image forming device includes the optical sensors SC that detect the amounts of light emitted by the light emitting elements E; the amount (estimated light amount) (Pj(n)×Pg(n)/Ph(n)) (first correction value) is calculated on the basis of the results of the detection performed by the optical sensor SC; the spectral sensitivity I(n) (second correction value) of the photosensitive drum 21 to light with a centroid wavelength is calculated; and the driving current value ID-Y (control signal) is corrected on the basis of the estimated light amount and the spectral sensitivity. Thus, the first embodiment is suitable for stabilizing the amounts of changes in the potentials of the portions of the photosensitive drum 21. The amounts of changes in the potentials of the portions of the photosensitive drum 21 can be stabilized against variations in the spectral distributions of the light emitting elements E, variations in the spectral sensitivity of the photosensitive drum 21, the temperatures of the light emitting elements, and degradation of the light emitting elements E.

The organic electroluminescence elements that are used as the light emitting elements E in the first embodiment are suitable for the invention. Since the spectral distributions of the organic electroluminescence elements vary more greatly than other elements such as light emitting diodes (LEDs), the aforementioned problem may easily occur. However, when the invention is applied to the configuration in which the organic electroluminescence elements are used as the light emitting elements E, an excellent image can be formed.

Second Embodiment

Figure 10:
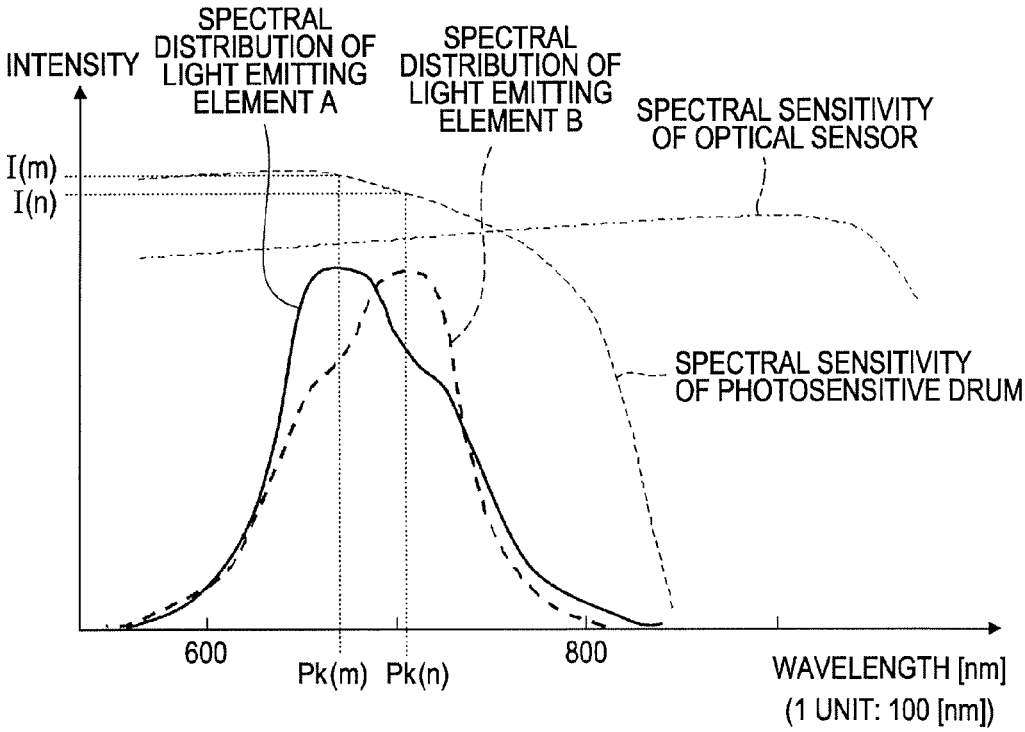
FIG. 10 is a graph showing a modified example of the light emitting control that is performed by the spectral sensitivity ratio data storage section and the correction circuit.

FIG. 10 is a graph showing a modified example of the light emission control performed by the spectral sensitivity ratio data storage section and the correction circuit. In the second embodiment, the light emission of the light emitting elements E is controlled on the basis of the spectral sensitivity of the photosensitive drum 21 to light with wavelengths that correspond to peak light intensities in the spectral distributions, instead of the centroid wavelengths calculated on the basis of the spectral distributions. This feature is different from the first embodiment.

In the second embodiment, the spectral sensitivity I(1), I(2), . . . , I(m), and I(n) of the photosensitive drum 21 to light with wavelengths Pk(1), Pk(2), . . . , Pk(m), and Pk(n) that correspond to the peak light intensities in the spectral distributions is calculated. One of the light emitting elements E is selected as a reference light emitting element E(ref). The following ratios are calculated as spectral sensitivity ratio data: the ratio I(1)/I(ref) of the spectral sensitivity I(1) of the photosensitive drum 21 to light emitted by the light emitting element E(1) to the spectral sensitivity I(ref) of the photosensitive drum 21 to light emitted by the reference light emitting element E(ref), the ratio I(2)/I(ref) of the spectral sensitivity I(2) of the photosensitive drum 21 to light emitted by the light emitting element E(2) to the spectral sensitivity I(ref), . . . , and the ratio I(n)/I(ref) of the spectral sensitivity I(n) of the photosensitive drum 21 to light emitted by the light emitting element E(n) to the spectral sensitivity I(ref). The line heads 29 are shipped from the factory under the condition that the spectral sensitivity ratio data I(1)/I(ref), I(2)/I(ref), . . . , and I(n)/I(ref) is stored in each of the spectral sensitivity ratio data storage sections CC3. The light emission control is performed on the basis of the spectral sensitivity ratio data in a similar manner to the first embodiment. Thus, the amounts of changes (due to the irradiation with light emitted by the light emitting elements E) in the potentials of the portions of the photosensitive drum 21 can be stabilized.

In the second embodiment, the driving current value ID-Y (control signal) is corrected on the basis of the spectral sensitivity of the photosensitive drum 21 to the spectral distribution of each of the light emitting elements E. Each of the light emitting elements E emits light on the basis of the corrected driving current value ID-Y. As a result, the amounts of changes in the potentials of the portions of the photosensitive drum 21 can be stabilized against variations in the spectral distributions of the light emitting elements E and variations in the spectral sensitivity of the photosensitive drum 21. Thus, an excellent image can be formed.

In the second embodiment, the driving current value ID-Y (control signal) is corrected on the basis of the spectral sensitivity of the photosensitive drum 21 to light that has been emitted by each of the light emitting elements E and has the wavelength that corresponds to the peak light intensity in the spectral distribution of the light emitting element E. Thus, the second embodiment is suitable for stabilizing the amounts of changes in the potentials of portions of the photosensitive drum 21. The wavelength that corresponds to the peak light intensity in the spectral distribution tends to vary depending on a variation in the spectral distribution. Thus, the value ID-Y (control signal) of the driving current that is to be applied to each of the light emitting elements E is corrected on the basis of the spectral sensitivity of the photosensitive drum 21 to light that has been emitted by the light emitting element E and has the wavelength that corresponds to the peak light intensity in the spectral distribution of the light emitting element E. Thus, the amounts of changes in the potentials of the portions of the photosensitive drum 21 can be stabilized against variations in the spectral distributions of the light emitting elements E and variations in the spectral sensitivity of the photosensitive drum 21.

In the second embodiment, the image forming device includes the optical sensors SC that detect the amounts of light emitted by the light emitting elements E. The amount (estimated light amount) (Pj(n)×Pg(n)/Ph(n)) (first correction value) is calculated on the basis of the results of the detection performed by each of the optical sensors SC. The spectral sensitivity I(n) (third correction value) of the photosensitive drum 21 to light with a wavelength that corresponds to a peak light intensity in the spectral distribution of each of the light emitting elements E is calculated. The driving current value ID-Y (control signal) is corrected on the basis of the estimated light amount and the spectral sensitivity. Thus, the second embodiment is suitable for stabilizing the amounts of changes in the potentials of portions of the photosensitive drum 21. The amounts of changes in the potentials of portions of the photosensitive drum 21 can be stabilized against variations in the spectral distributions of the light emitting elements E, variations in the spectral sensitivity of the photosensitive drum 21, the temperatures of the light emitting elements E and degradation of the light emitting elements E.

Third Embodiment

In the first and second embodiments, the driving current value ID-Y is calculated so that the light emitting element E emits light with an amount obtained by multiplying the amount Pj(n)×Pg(n)/Ph(n) estimated on the basis of the value detected by the optical sensor SC by the spectral sensitivity ratio I(n)/I(ref). In other words, the driving current value ID-Y is corrected on the basis of the spectral sensitivity ratio I(n)/I(ref) in the first and second embodiments. The data TD-Y that indicates the time period for which the light emitting element E emits light may be corrected on the basis of data on the spectral sensitivity ratio I(n)/I(ref).

Figure 11:
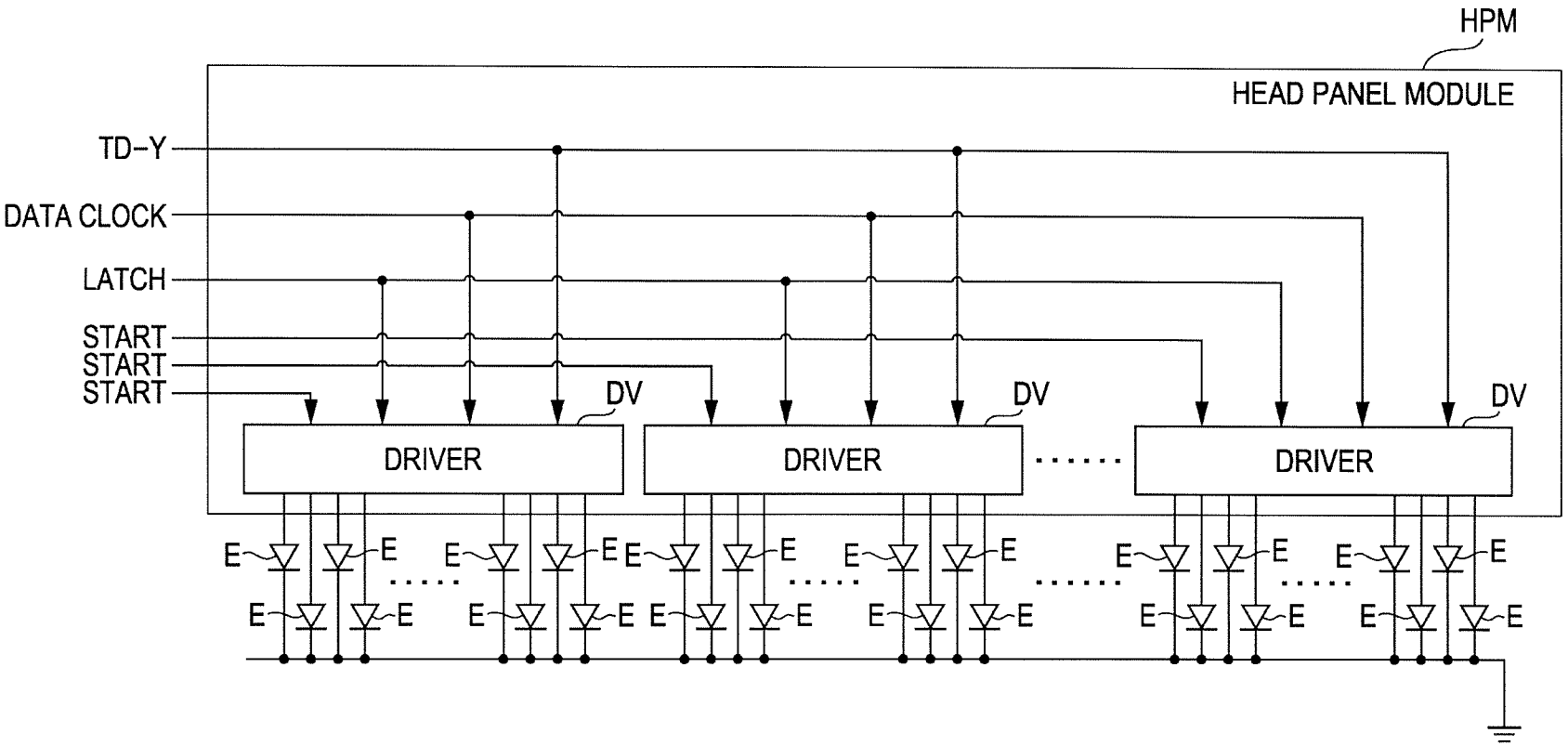
FIG. 11 is a block diagram showing the configuration of a head panel module.

FIG. 11 is a block diagram showing the configuration of a head panel module HPM that is included in each of the line heads 29. Each of the head panel modules HPM causes, on the basis of the data TD-Y, the light emitting elements E to emit light. The head panel modules HPM are provided for the line heads 29 (for yellow, magenta, cyan and black colors), respectively. Since the configurations of the head panel modules HPM are the same or similar to each other, the head panel module HPM provided in the Y line head 29 is described below as an example.

The head panel module HPM includes drivers DV that supply driving currents to the light emitting elements E at appropriate times. Each of the drivers DV includes: a shift register that stores the data TD-Y; a latch circuit that latches the data TD-Y; and an emission control circuit that controls, on the basis of the latched data TD-Y, time periods for which the light emitting elements E emit light.

Figure 12:
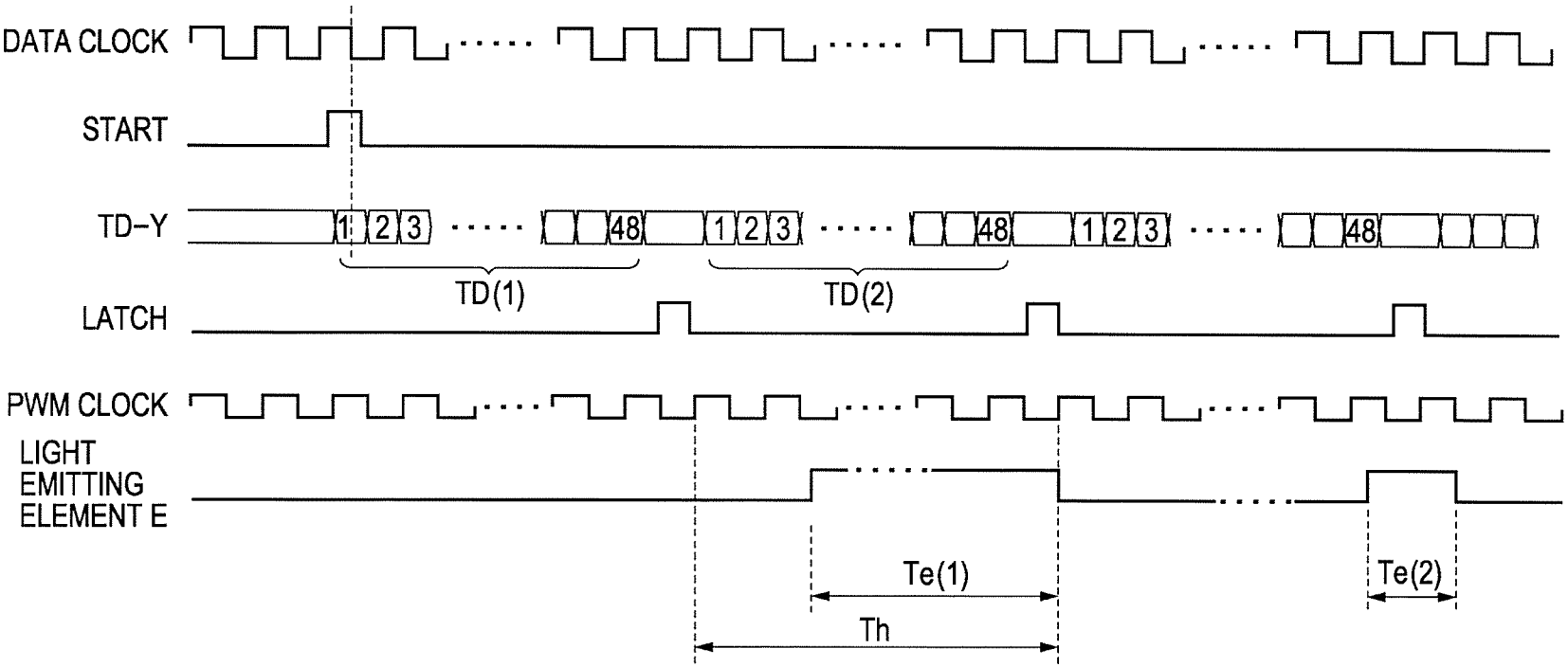
FIG. 12 is a timing chart showing an example of controlling the time periods for which a light emitting element emits light.

Each of the drivers DV receives a start pulse that provides a trigger to activate the shift register. The start pulse is generated by the Y line head control circuit CC on the basis of a synchronization signal Sync transmitted by the main controller MC. Then, the start pulse is supplied to each of the drivers DV. Each of the shift registers receives the start pulse and is activated. Each of the shift registers shifts the data TD-Y in synchronization with a data clock so that data TD-Y for one line is stored in the shift register included in the drivers DV. After that, the driving current with the value ID-Y is supplied to each of the light emitting elements E in synchronization with a PWM clock for the time period indicated by the data TD-Y that has been latched by a latch signal. In this manner, the time period for which each of the light emitting elements E emits light is controlled (refer to FIG. 12). FIG. 12 is a timing chart of an example of controlling the time period for which the light emitting element E emits light. FIG. 12 shows times when 48 data pieces output from 48 output terminals of one of the drivers DV are latched. FIG. 12 also shows time periods for which a certain one of the light emitting elements E that are connected to the 48 output terminals of the driver DV emits light. In the example shown in FIG. 12, the certain light emitting element E emits light for a time period Te(1) on the basis of data that corresponds to data TD(1). After that, the certain light emitting element E emits light for a time period Te(2) on the basis of data that corresponds to data TD(2) that follows the data TD(1). In this case, light emission duty ratios are expressed by Te(1)/Th, Te(2)/Th, . . . , etc., where Th indicates a time period (scanning time period for one line) that is required for a latent image for one line to be formed. The amount of energy that is provided to the surface of the photosensitive drum 21 by the light emitting element E is controlled by increasing or reducing the light emission duty ratios.

In the present embodiment, the data TD-Y that indicates the time period for which the light emitting element E emits light is corrected (instead of correcting the driving current value ID-Y on the basis of the data on the spectral sensitivity ratio I(n)/I(ref)) so that the light emission duties of the light emitting element E are adjusted. The amounts of changes (due to the irradiation with light emitted by the light emitting elements E) in the potentials of the portions of the photosensitive drum 21 can be stabilized by controlling the light emission of the light emitting elements E.

In the third embodiment, the data TD-Y (control signal) is corrected on the basis of the spectral sensitivity of the photosensitive drum 21 to the spectral distribution of each of the light emitting elements E, and the light emitting element E emits light on the basis of the corrected data TD-Y. As a result, the amounts of changes in the potentials of the portions of the photosensitive drum 21 can be stabilized against variations in the spectral distributions of the light emitting elements and variations in the spectral sensitivity of the photosensitive drum 21. Thus, an excellent image can be formed.

Others

In the aforementioned embodiments, each of the line heads 29, or the heads 29 and the controller HC, corresponds or correspond to an "exposure head" according to the invention; each of the photosensitive drums 21 corresponds to a "photoreceptor" according to the invention; each of the line head control circuits CC corresponds to a "light emission controller" according to the invention and a "correcting section" according to the invention; and each of the developers 25 corresponds to a "developing section" according to the invention. In the first and second embodiments, each of the driving current values ID-Y corresponds to a "control signal" according to the invention. In the third embodiment, the data TD-Y corresponds to the "control signal" according to the invention. In addition, each of the optical sensors SC corresponds to a "detector" according to the invention.

The invention is not limited to the aforementioned embodiments and may be modified in various manners without departing from the gist of the invention. For example, the image forming device according to the first and second embodiments has the configuration to correct, on the basis of the results of the detection performed by the optical sensors SC, the amounts of light that is emitted by the light emitting elements. However, the image forming device according to the first and second embodiments does not need to have the configuration.

In the aforementioned embodiments, the light emission of the light emitting elements E is controlled on the basis of the centroid wavelengths (calculated on the basis of the spectral distributions of the light emitting elements E) or the wavelengths that correspond to the peak light intensities in the spectral distributions of the light emitting elements E. However, the light emitting elements E may be controlled to emit light according to the following formula instead of the aforementioned formula 1 while the spectral distributions Pi(λi) (over wavelengths λi) of the light emitting elements E are stored, and a reference spectral distribution Qi(λi) is stored as the spectral distribution of an ideal light emitting element E.

$$\left(\sum_i Pi(\lambda i)\times f(\lambda i)\right)\Big/\left(\sum_i Qi(\lambda i)\times f(\lambda i)\right) \qquad \text{Formula 2}$$

In formula 2, f(λi) is a function of the spectral sensitivity of the photosensitive drum 21.

In the aforementioned embodiments, the bottom emission type organic electroluminescence elements are used as the light emitting elements E. However, top emission type organic electroluminescence elements may be used as the light emitting elements E.

The line heads 29 that are used in the invention are not limited to the line heads each of which includes the refractive index distribution type rod lens array RLA as an optical system. For example, line heads that are described in JP-A-2008-36937 may be used. Each of the line heads described in JP-A-2008-36937 includes imaging optical systems each of which is constituted by a convex lens. Each of the line heads described in JP-A-2008-36937 also includes groups of a predetermined number of light emitting elements. The groups of light emitting elements face the imaging optical systems, respectively.

The entire disclosure of Japanese Patent Applications No. 2009-238253, filed on Oct. 15, 2009 is expressly incorporated by reference herein.

What is claimed is:

1. An image forming device comprising:

an exposure head that includes a light emitting element and a light emission controller that causes the light emitting element to emit light on the basis of a control signal, the light having a spectral distribution;

a photoreceptor that is exposed to the light emitted by the light emitting element included in the exposure head so that a latent image is formed on the photoreceptor, the photoreceptor having a spectral sensitivity;

a correcting section that confirms a relationship between the spectral sensitivity and the spectral distribution, and that corrects the control signal on the basis of the relationship; and a developing section that develops the latent image formed on the photoreceptor, the correcting section that corrects the control signal on the basis of the spectral sensitivity of the photoreceptor at a centroid wavelength of the spectral distribution of the light.

2. The image forming device according to claim 1, wherein the correcting section corrects the control signal on the basis of the spectral sensitivity of the photoreceptor to light with a wavelength that corresponds to a peak light intensity in the spectral distribution.

3. An image forming device comprising:

an exposure head that includes a light emitting element and a light emission controller that causes the light emitting element to emit light on the basis of a control signal;

a photoreceptor that is exposed to the light emitted by the light emitting element included in the exposure head so that a latent image is formed on the photoreceptor;

a correcting section that corrects the control signal on the basis of the spectral sensitivity of the photoreceptor to a spectral distribution of the light emitting element;

a developing section that develops the latent image formed on the photoreceptor; and a detector that detects the amount of the light emitted by the light emitting element, the correcting section correcting the control signal on the basis of the spectral sensitivity of the photoreceptor at a centroid wavelength of the spectral distribution of the light, the correcting section calculating a first correction value on the basis of the results of the detection performed by the detector, calculating the spectral sensitivity of the photoreceptor to the light with the centroid wavelength as a second correction value, and correcting the control signal on the basis of the first and second correction values.

4. An image forming device comprising:

an exposure head that includes a light emitting element and a light emission controller that causes the light emitting element to emit light on the basis of a control signal;

a photoreceptor that is exposed to the light emitted by the light emitting element included in the exposure head so that a latent image is formed on the photoreceptor;

a correcting section that corrects the control signal on the basis of the spectral sensitivity of the photoreceptor to a spectral distribution of the light emitting element;

a developing section that develops the latent image formed on the photoreceptor; and a detector that detects the amount of the light emitted by the light emitting element the correcting section correcting the control signal on the basis of the spectral sensitivity of the photoreceptor at a wavelength that corresponds to a peak light intensity in the spectral distribution of the light, the correcting section calculating a first correction value on the basis of the results of the detection performed by the detector, calculating, as a third correction value, the spectral sensitivity of the photoreceptor to the light with the wavelength corresponding to the peak light intensity, and correcting the control signal on the basis of the first and third correction values.

5. An image forming method comprising:

confirming a relationship between spectral sensitivity of a photoreceptor and a spectral distribution of a light emitting element;

correcting a control signal for light emission of a light emitting element, on the basis of the relationship;

exposing a photoreceptor to light that has been emitted by the light emitting element on the basis of the corrected control signal and forming a latent image on the photoreceptor; and developing the formed latent image, the correcting the control signal includes correcting the controls signal on the basis of the spectral sensitivity of the photoreceptor at a centroid wavelength of the spectral distribution of the light.

* * * * *